US005931040A

United States Patent [19]

Kimura et al.

[11] Patent Number: 5,931,040

[45] Date of Patent: Aug. 3, 1999

[54] ROUGH ROLLING MILL TRAIN

[75] Inventors: Tomoaki Kimura; Shigezi Kaneko, both of Hitachi, Japan

[73] Assignee: Hitachi, Ltd., Tokyo, Japan

[21] Appl. No.: 08/974,282

[22] Filed: Nov. 19, 1997

[30] Foreign Application Priority Data

Nov. 19, 1996 [JP] Japan ..... 8-307878

[51] Int. Cl.[6] ..... B21B 13/08

[52] U.S. Cl. ..... 72/234

[58] Field of Search ..... 72/234, 226, 225, 72/224, 237, 200, 202, 229

[56] References Cited

U.S. PATENT DOCUMENTS

| | | | |
|---|---|---|---|
| 4,433,566 | 2/1984 | Tippins et al. | 72/229 |
| 4,522,050 | 6/1985 | Thomas | 72/229 |
| 4,578,983 | 4/1986 | Kimura | 72/407 |

FOREIGN PATENT DOCUMENTS

| | | |
|---|---|---|
| 4-367305 | 12/1992 | Japan . |
| 5-161902 | 6/1993 | Japan . |
| 7-308701 | 11/1995 | Japan . |
| 9-239413 | 9/1997 | Japan . |

*Primary Examiner*—Joseph J. Hall, III
*Assistant Examiner*—Rodney Butler
*Attorney, Agent, or Firm*—Evenson, McKeown, Edwards & Lenahan, P.L.L.C.

[57] ABSTRACT

The present invention is directed to a rough rolling mill for rolling a slab of material into a rough bar through a hot rolling process. The rolling mill reduces material temperature drop thereby preventing a decrease in productivity. The rolling mill train for producing a rough bar from a slab of material has at least two close mill couples at an outlet side thereof. Each close mill couple is composed of two rolling mills arranged in tandem close to one another to roll the material. The at least two close mill couples are arranged so that the material being rolled is not acted upon by adjacent close mill couples at the same time.

7 Claims, 5 Drawing Sheets

ROUGH ROLLING MILL TRAIN

BACKGROUND OF THE INVENTION

The present invention relates to a rough rolling mill train in a hot rolling mill equipment which effects thickness reduction hot rolling of a flat slab to produce a thin plate and, more particularly, to a rough rolling mill train which is suitable to decrease temperature lowering of a rolling material (rough bar) during rough rolling and improve the productivity thereof thereby.

In a hot rolling mill equipment which produces a thin plate through thickness-reduction hot rolling of a slab, a rough rolling mill train is for rolling of a material from a slab to a rough bar. The rough bar is sent to a finish rolling mill train to be further rolled for reduction of thickness, whereby a hot strip (thin plate) is produced. Usually, the thickness of the slab is 200–280 mm, the width is 700–2,200 mm and the length is 6–13 m.

Hitherto, such a slab would be rolled to reduce the thickness through rolling of 6 passes in total (usual pass numbers) from the slab of thickness 200–280 mm to a rough bar of thickness 20–40 mm, using a rough rolling mill train of arrangement as illustrated in FIG. 5*a*, 5*b*, 5*c*, 5*d*. The rough rolling mill train illustrated in FIG. 5*a* is a semi-continuous rough rolling mill train which has one rolling mill RSB effecting one pass one way rolling and one reversing rolling mill R11 effecting 5-pass reversing rolling. A rough rolling mill train illustrated in FIG. 5*b* is a full-continuous rough rolling mill train for effecting 6-pass rolling by 6 rolling mills R21–R26 each effecting one way rolling. A rough rolling mill train illustrated in FIG. 5*c* is a three quarters type rough rolling mill train which has, at the outlet side of one rolling mill R31 effecting one pass one way rolling, one reversing rolling mill R32 effecting 3-pass reversing rolling and two rolling mills R33, R34 each effecting one way rolling. Further, a rough rolling mill train illustrated in FIG. 5*d* is a close couple type rough rolling mill provided with one reversing rolling mill R42 effecting 3-pass reversing rolling at the outlet side of one rolling mill R41 effecting one-pass one way rolling, and one close couple rolling mill R40 having 2 rolling roll assemblies R43, R44 arranged close to each other within one housing to roll a rolling material in turn.

However, in the above-mentioned rough rolling mill trains, since a distance between rolling mill stands is long, about 40 m, the equipment length in any case of FIGS. 5*a* to 5*b* becomes longer than 100 m, and since a rolling material is developed on tables between rolling mill stands as thickness reduction rolling progresses, a hot-rolling material grows cold on the tables and a large temperature drop such as more than 100° C. occurs in some cases.

Further, in a case of FIG. 5*a*, a rolling material is stopped of travelling at each pass, rolling of reversing pass is effected after a screw down amount of rolling rolls, etc. at the rolling mill is reset, so that a lot of time is required and the productivity is lowered remarkably. Particularly, the rolling material is elongated to be very long around the final pass, so that reversing rolling under such a condition requires much longer time. Further, in cases of FIGS. 5*c* and 5*d*, also, reversing rolling is effected, so that a lot of time is required for rolling and the productivity is feared to decrease.

On the contrary, an example of a rough rolling mill train, which is suited for improving the temperature lowering and the productivity decrease, is disclosed in JP A 4-367305. This prior art is a reversing type rough rolling mill train which is provided with two thickness reduction rolling mills (twin mills), in each of which two pairs of work rolls (2-high rolling roll assemblies) are arranged in series in an adjacent relation with each other within one housing. According to this system, since the number of times that the rolling material is developed on tables is decreased, it is possible to reduce remarkably a temperature drop. Further, in the prior art, since a rolling material is rolled in a tandem condition in one direction without reversing rolling, the productivity lowering as mentioned above is avoided.

Further, JP A 5-161902 discloses a rolling mill equipment in which two double rolling mills are arranged in tandem close to each other with a distance of 6 m between rolling mill stands. According to this example, it is possible to improve the temperature drop as mentioned above.

In the rough rolling mill trains illustrated in FIGS. 5*a* to 5*d*, since the above-mentioned temperature drop occurs and a lot of time is required for rolling, there is some fear of decrease in productivity.

Further, in the prior art disclosed in the JP A 4-367305, a rolling material bestrides a plurality of rolling mills arranged tandem during rolling and it is rolled continuously. The term bestrides when used in this context refers to the rolling material essentially being worked upon by two adjacent tandem rolling mills as described and illustrated in JP A 4-367305. In that system, a rolling speed is large at a final outlet side of the rolling mill train but small at an inlet side of the rolling mill train. For example, supposing that the thickness of a slab is 240 mm at an inlet side of a rough rolling mill train, the thickness of a rough bar is 30 mm at an outlet side and the rough bar is rolled at a usual speed of 200 m/min, a speed of the slab at the inlet side becomes slow, about 25 m/min. Therefore, a contact time between the rolling rolls and the rolling material becomes long, the rolling material is cooled, temperature of the rolling rolls are raised, and there was the possibility that the life of the rolling rolls be reduced remarkably.

SUMMARY OF THE INVENTION

An object of the present invention is to provide a rough rolling mill train which, in a case where a rough bar is produced through rough hot rolling of a slab, is capable of decreasing a drop in temperature of the rough bar and does not lower productivity.

In order to achieve the above object, according to the present invention, provided is a rough rolling mill train which is provided in a hot rolling mill equipment for producing a thin plate through thickness reduction hot rolling of a slab and effects rough rolling of the slab to attain a rough bar, and which is characterized in that two or more close mill couples, in each mill couple of which two rolling mills are arranged in tandem, preferably close to each other and a rolling material is rolled in turn by the two rolling mills, are provided in the rolling mill train at an outlet side thereof, and respective close mill couples are arranged spaced by such a distance that the rolling material does not bestride the adjacent close mill couples to effect one way rolling.

As a rolling mill of a first turn of the above-mentioned rolling mill train from the inlet side thereof, preferably, a single independent rolling mill is arranged and used to selectively effect one pass one way rolling and three pass reversing rolling according to the thickness of a rolling material.

More preferably, a rolling mill, at the outlet side of the close couple of mills of at least a final stage of the rough rolling mill train from the outlet side of the rolling mill train, is a multi roll rolling mill having 4 or more-high rolling rolls.

In the present invention of the above-mentioned construction, 2 or more close mill couples are provided in the rolling mill train at least at the outlet side of the rolling mill train. In each close mill couple, a rolling material is rolled in turn by two rolling mills arranged close to each other, so that it is possible to decrease the length, developed on a roller table, of the rolling material, particularly, a thin and long rolling material the thickness of which became close to the thickness of a rough bar. For example, it is possible to omit at least 2 times of the number of times that the rolling material is developed on the tables, as compared with a rough rolling mill train in which 6 rolling mills are arranged in tandem, whereby it is possible to suppress a drop in temperature of the rolling material, and to obtain a rough bar of relatively high temperature with a less change in temperature. Further, since two rolling mills are arranged close to each other in a close mill couple, the length of the whole equipment can be shortened.

Further, respective close mill couples are arranged with such spacing that a rolling material does not bestride the adjacent close mill couples, whereby a rolling speed at each close mill couple can be set independently from each other. That is, a rolling speed at which the rolling material passes through one close mill couple depends only on the two rolling mills in the close mill couple and becomes independent of a rolling speed of the other rolling mill or mills and it is possible to adjust a rolling speed of the rolling material within a period of time from a time when the rolling material tails out of the close mill couple to a time when it is threaded into the next close mill couple.

For example, in a case where a rough bar is obtained through thickness reduction rolling from a thickness of 80 mm to a thickness of 30 mm by the rolling mills in the close mill couple of rolling mills at the final stage, when a rolling speed of the rough bar at the outlet side is set to 200 m/min, a rolling speed of the rolling material at the inlet side of the close mill couple of rolling mills is as follows:

$$(30/80)\times 200=75 \text{ m/min.}$$

However, if it is possible to reduce the rolling speed after tailing out from the close mill couple at one stage before the final stage, it also is possible to set the rolling speed at the outlet side of the close mill couple at the preceding stage to a sufficiently fast speed of about 200 m/min.

Therefore, particularly, it is possible to set a rolling speed at the rolling mill at a preceding stage side to a large one, as a result, it is possible to suppress a drop in temperature of a rolling material and to make a temperature elevation of the rolls less.

Further, in the present invention, since two or more close mill couples arranged in series effect one way rolling, a screw down amount at each rolling roll can be set in advance, it is unnecessary to stop travelling of a rolling material at each pass, and the productivity is prevented from lowering.

Further, in a case where the thickness of a slab threaded into the rough rolling mill is relatively thick, a screw down amount of the rolling material before entering the above-mentioned two close mill couples is made large, so that it may be considered to effect reversing rolling at the preceding stage in some cases. In the present invention, in order to treat of such a case, as the rolling mill of a first turn of the rolling mill train from the inlet side thereof, a rolling mill is used which is provided with one rolling roll assembly and selectively effect one pass one way rolling and reversing three pass rolling according to the thickness of the rolling material. Thereby, by effecting the reversing three pass rolling by the rolling mill of a first turn from the inlet side of the rolling mill train, a large screw down amount before entering the two close mill couples can be employed. In this case, since a rolling mill in a preceding stage of the rough rolling mill train effects reversing rolling, the length of the rolling material is short and a rolling time required for the reversing rolling is relatively short, therefore, there is almost not the concerning that the productivity is lowered.

Further, by constructing a roll assembly of a rolling mill at the outlet side of a close mill couple of at least a final stage to be 4 or more-high, multi roll rolling roll assembly, it is possible to make the work roll small in diameter by providing a roll reinforcing the work roll. Thereby, it is possible to roll a rolling material which became thin at the final stage of the rolling mill train while preventing the roll from becoming flat, and it is possible to control a rolling load to be small. On the contrary, by constructing a roll assembly of a rolling mill at the inlet side of a close mill couple of at least a final stage to be 4 or more-high, multi roll rolling roll assembly, it is possible to make the work roll diameter of the rolling roll assembly larger to improve bending strength of the roll and to improve a biting ability and increase a screw down amount in a case where a thick rolling material is rolled at a preceding stage of the rough rolling mill train, whereby it become advantageous to a decrease of total rolling pass numbers.

DESCRIPTION OF EMBODIMENTS OF THE INVENTION

Figure 1:
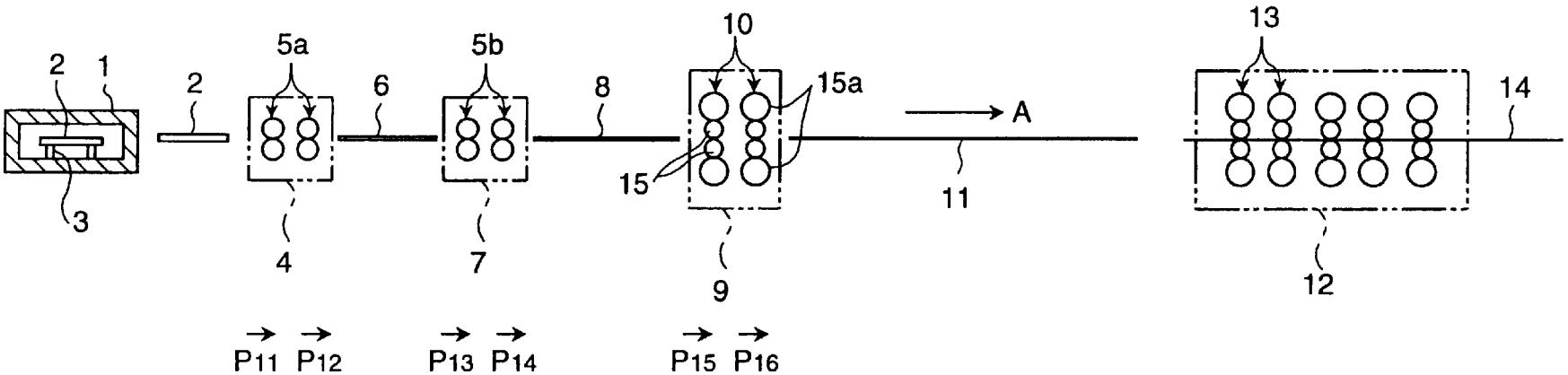
FIG. 1 is a schematic diagram of a rough rolling mill equipment including a rough rolling mill train of a first embodiment of the present invention.

A first embodiment of the present invention is explained, referring to FIG. 1.

FIG. 1 shows a rough rolling mill equipment including a rough rolling mill train of the present embodiment. In FIG. 1, a rolling material is rolled in a direction of an arrow A. As shown in FIG. 1, the rough rolling mill equipment has, from an inlet side, a heating furnace 1 reheating a slab 2, a first close mill couple 4 in which two 2-high rolling mills 5*a* (each of which has one rolling roll at each of up and down sides) are arranged tandem and close to each other, a second close mill couple 7 which is equipped subsequently to the first close mill couple 4 and has two 2-high rolling mills 5*b* (each of which has one rolling roll at each of up and down sides) arranged in tandem and close to each other, and a third close mill couple 9 which is equipped subsequently to the second close mill couple 7 and has two 4-high rolling mills 10 (each of which has two rolling rolls at each of up and down sides) arranged in tandem and close to each other.

Instead of each of the above-mentioned close mill couples 4, 7 and 9, a twin mill as disclosed in JP A 7-308701, JP A 9-239413 can be used. The twin mill comprises one housing and a pair of rolling roll assemblies arranged in tandem close to each other in the housing.

Further, although illustration is omitted, roller tables are provided between the above-mentioned close mill couples. Two adjacent close mill couples among the first close mill couple 4, the second close mill couple 7 and the third close mill couple 9 are spaced from each other by such a distance that a rolled and elongated rolling material does not bestride the two adjacent close mill couples. That is, a distance between the first close mill couple 4 and the second close mill couple 7 is such that a rolling material 6 does not bestride both of the first close mill couple 4 and the second close mill couple 7, and a distance between the second close mill couple 7 and the third close mill couple 9 is such that a rolling material 8 does not bestride both of the second close mill couple 7 and the third close mill couple 9. The term bestride as used in conjunction with the present invention refers to the position of the rolling material being acted upon by the close mill couples. For example, as shown in FIG. 5*a*–5*d* which illustrate a variety of conventional continuous-type rolling mills, if the rolling material is acted upon by adjacent mills at the same time, the rolling material would bestride the adjacent mills. In the present invention as shown in FIG. 1, the distance between close mill couples 4, 7 and 9 is such that the rolling material 6 is not acted upon by adjacent close mill couples at the same time. Thus, according to the present invention, during a rolling operation, rolling material 6 is not acted upon or, in other words, does not bestride adjacent close rolling couples 4 and 7 or 7 and 9.

In the construction as mentioned above, the slab 2 is mounted on a skid 3 and heated to a prescribed temperature in the heating furnace 1. The heated slab 2 is extracted from the heating furnace 1, and first, it is rolled in turn by the two 2-high rolling mills 5*a* of the first close mill couple 4. The rolling by the first close mill couple 4 is one way rolling as shown by an arrow P11 of a first pass and by an arrow P12 of a second pass.

The rolling material 6 rolled by the first close mill couple 4 is transferred to the next close mill couple 7 and rolled in turn by the two 2-high rolling mills 5*b*. The rolling by this second close mill couple 7 also is one way rolling as shown in figure by an arrow P13 of a third pass and an arrow P14 of a fourth pass.

Further, the rolling material 8 rolled by the second close mill couple 7 is transferred to the next close mill couple 9, and rolled by the two 4-high rolling mills 10 in turn. Each of the 4-high rolling mills 10 has a construction such that work rolls 15 are reinforced by reinforcing rolls 15*a*. The rolling material 8 is rolled to extend by the work rolls 15, whereby a rough bar 11 is obtained. The rolling by this close mill couple 9 also is one way rolling as shown in FIG. 1 by an arrow P15 of a fifth pass and an arrow P16 of a sixth pass.

Next, the rough bar 11 obtained by the above-mentioned rough rolling mill train is rolled for finish by a finish rolling mill train 12 in which a lot of 4-high rolling mills 13 are arranged in series, whereby a strip 14 is produced.

As mentioned above, a slab 2 and rolling materials 6, 8 are rolled in turn by the close mill couples 4, 7 and 9, each of which has two rolling mills arranged in tandem and close to each other, so that the number of times that rolling materials are developed on the roller tables can be reduced and a drop in temperature of the rolling materials can be suppressed. Further, since each of the close mill couples 4, 7 and 9 has two rolling mills arranged close to each other, the length of the whole equipment can be shortened.

Further, since the close mill couples 4, 7 and 9 are spaced by such distance that the rolling material 6, 8 does not bestride adjacent close mill couples, a rolling speed of each of the close mill couples 4, 7 and 9 can be set independently of each other, and a speed of each rolling material 6, 8 can be reduced between the close mill couples 4, 7 and 9. Thereby, particularly, it is possible to increase a rolling speed at the rolling mill (the close mill couple) at a preceding stage side, whereby a contact time between the rolling material and rolls can be shortened, so that a drop in temperature of the rolling material can be suppressed and an elevation in temperature of the rolls can be made less.

Further, in the present embodiment, since one way rolling is effected by three pairs of rolling mills of the close mill couples 4, 7 and 9 arranged in series, a screw down amount at each rolling roll can be set in advance, it is unnecessary to stop travelling of the rolling material at each pass, the productivity is prevented from decreasing and a drop in temperature of a rolling material can be prevented.

Further, by constructing the rolling roll assemblies of the rolling mills in the close mill couples 4 and 7 at a preceding stage side to be 2-high rolls, it is possible to improve roll bending strength by using rolling rolls of large diameter. It is possible to improve a biting ability and to increase a screw down amount when a thick rolling material is rolled by the rolling mills at a preceding stage side in the rough rolling mill train, which is advantageous for reducing the total rolling pass numbers. Additionally, it also is possible to reduce an equipment cost by employing the simplest 2-high rolls.

Further, it should be taken as a matter of course that distances between the close mill couples 4, 7 and 9 as mentioned above are desirable to be necessary and smallest distances, considering the length of each rolling material 6, 8.

Figure 2:
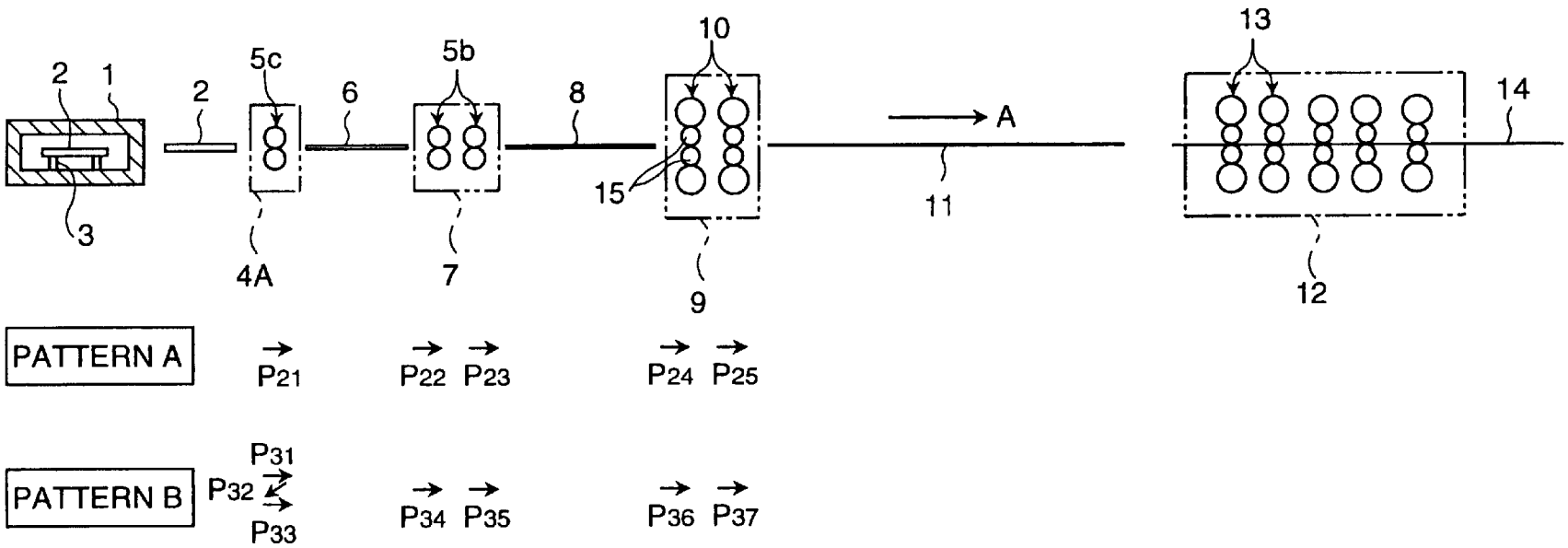
FIG. 2 is a schematic diagram of a rough rolling mill equipment including a rough rolling mill train of a second embodiment of the present invention.

A second embodiment of the present invention is explained, referring to FIG. 2.

In this embodiment, a 2-high rolling mill 4A having one rolling roll assembly 5*c* is provided instead of the close mill couple 4 of FIG. 1. In this case, also, adjacent two rolling mills among the rolling mill 4A, the close mill couple 7 and the close mill couple 9 are spaced by such a distance that a rolled elongated rolling material does not bestride the adjacent rolling mills. The construction and operation other than the above-mentioned are the same as for the first embodiment. In FIG. 2, the same reference numbers as in FIG. 1 are given members equivalent to ones in FIG. 1.

In a case where the thickness of a slab 2 introduced into the rough rolling mill train is relatively thick, since a screw down amount for the rolling material before entering the close mill couples 7, 9 is made large, it is considered to use a reversing rolling mill in some cases. This embodiment is constructed to be applicable in such a case, the rolling mill 4A is a rolling mill which is able to selectively effect one pass one way rolling and 3 pass reversing rolling. It is decided according to the thickness of the slab 2 and the rolling material 6 to take which type rolling.

For example, in a case where the thickness of the slab 2 is a usual size, a pattern A as shown at a lower portion of FIG. 2 is taken, that is, one pass one way rolling P21 by the rolling mill 4A and subsequent rolling indicated by P22–P25 by the close mill couples 7 and 9 are practiced. On the other hand, in a case where the thickness of the slab 2 is thicker than a usual thickness, a pattern B as shown at a lower portion of FIG. 2 is taken, that is, three pass reversing rolling P31, P32, P33 by the rolling mill 4A and subsequent rolling indicated by P34–P37 by the close mill couples 7 and 9 are practiced. Consequently, 5 passes in total are rolled in the pattern A, and 7 passes in total are rolled in the pattern B.

In this manner, by effecting 3 pass reversing rolling by a rolling mill of a first turn from an entrance side of the rolling mill train in a case where the thickness of the slab 2 is thicker than a usual thickness, a screw down amount before entering the two pairs of the rolling mills, or two close mill couples 7, 9 can be made large. In this case, since reversing rolling is effected by a rolling mill at a preceding stage side of the rough rolling mill, the length of the rolling material 6 is relatively short, a rolling time required for the reversing rolling also is short, therefore, there is almost not the fear that the productivity is reduced.

According to the present embodiment as explained above, the effect that a screw down amount before entering the close mill couples 7, 9 can be made large in a case where the thickness of the slab 2 is thicker than a usual thickness, in addition to that the same effect as in the first embodiment is attained.

Figure 3:
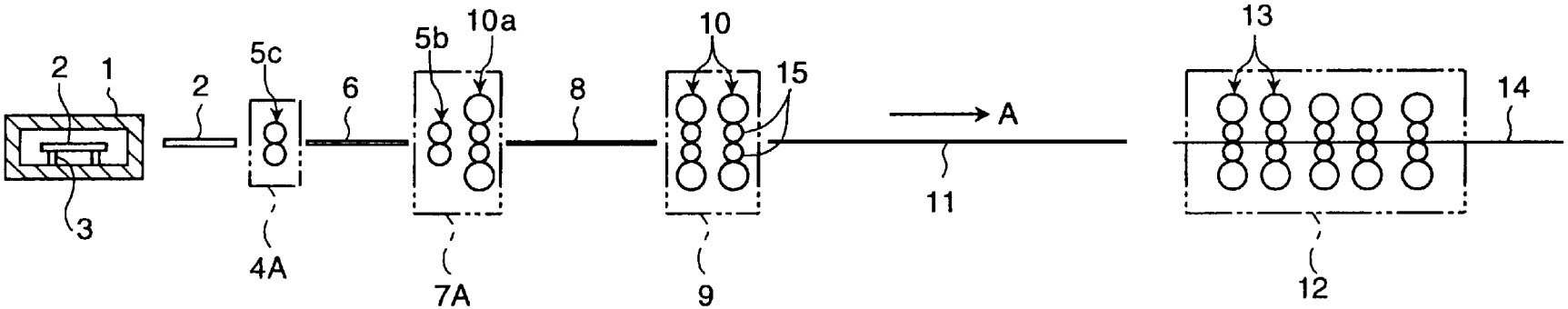
FIG. 3 is a schematic diagram of a rough rolling mill equipment including a rough rolling mill train of a third embodiment of the present invention.

A third embodiment of the present invention is explained, referring to FIG. 3.

In this embodiment, a close mill couple 7A is provided instead of the close mill couple 7 of a second turn in FIG. 2, which close mill couple 7A has a 2-high rolling mill 5*b* provided with one 2-high rolling roll assembly (comprising one rolling roll at each of upper and lower sides) and a 4-high rolling mill provided with one 4-high rolling roll assembly 10*a* (comprising 2 rolling rolls at each of upper and lower sides) arranged in tandem close to each other. In this case, also, adjacent two rolling mills among the rolling mill 4A, the close mill couple 7A and the close mill couple 9 are spaced by such a distance that a rolled elongated rolling material does not bestride the adjacent rolling mills 4A, 7A, 9. The construction and operation other than the above-mentioned are the same as the second embodiment. In FIG. 3, the same reference numbers as in FIG. 2 are given members equivalent to ones in FIG. 2.

In the close mill couple 7A shown in FIG. 3, since the rolling roll assembly 5*b* of the rolling mill at an inlet side is 2-high, it is possible to improve the bending strength by using a rolling roll of large diameter, and in a case where the thickness of a rolling material from the rolling mill 4A is thick, a screw down amount therefor can be made large. On the other hand, since the rolling roll assembly 10*a* of the rolling mill of the close mill couple 7A at an outlet side is made 4-high, it is possible to make the diameter of the work roll small, it is possible to roll the rolling material at an after stage which became thin in thickness while preventing the rolling roll from being flattened, and it is possible to control the rolling load so as to be small.

According to this embodiment as mentioned above, in addition to that the same effect as in the first and second embodiments is attained, since the rolling roll assembly 10*a* of the rolling mill of the close mill couple 7A at an outlet side is made 4-high, it is possible to roll the rolling material at the after stage which became thin by the work roll small in diameter with a small rolling load.

Figure 4:
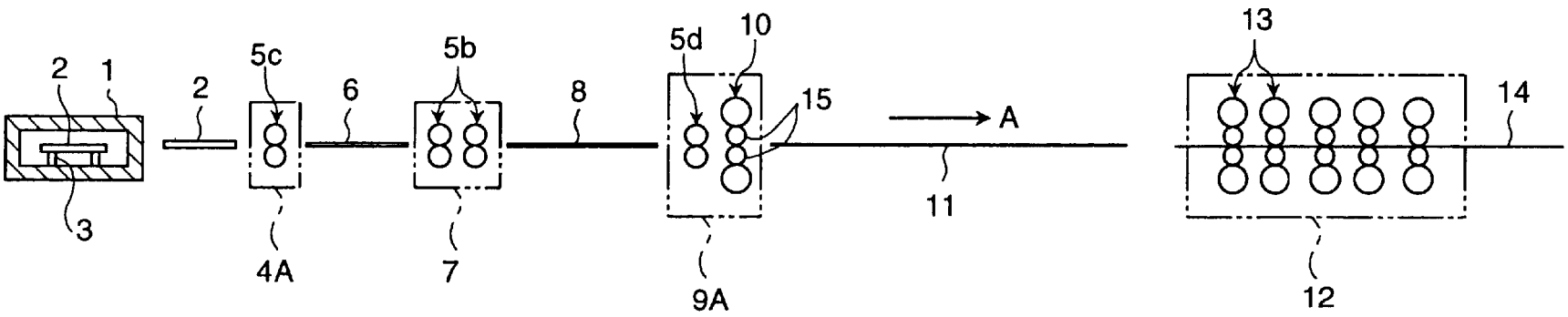
FIG. 4 is a schematic diagram of a rough rolling mill equipment including a rough rolling mill train of a fourth embodiment of the present invention.
Figure 5A:
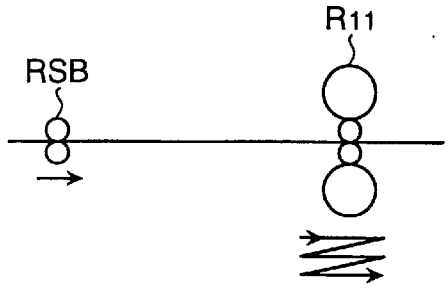
FIG.5a PRIOR ART
FIG. 5*a* is a schematic diagram of a semi-continuous type rough rolling mill train of a conventional rolling mill equipment.
Figure 5B:
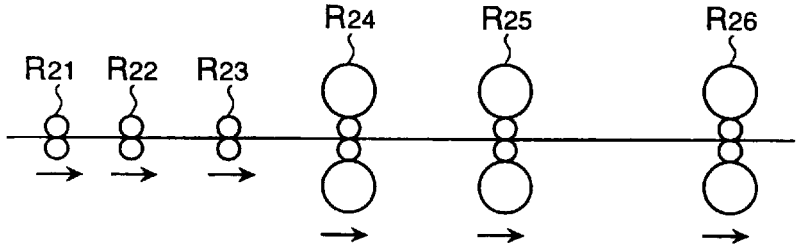
FIG.5b PRIOR ART
FIG. 5*b* is a schematic diagram of a full-continuous type rough rolling mill train of a conventional rolling mill equipment.
Figure 5C:
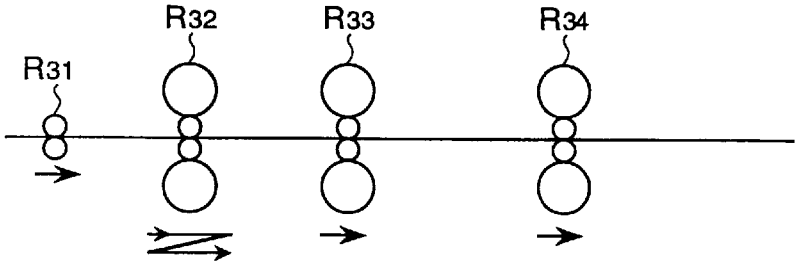
FIG.5c PRIOR ART
FIG. 5*c* is a schematic diagram of a three quarter type rough rolling mill train of a conventional rolling mill equipment.
Figure 5D:
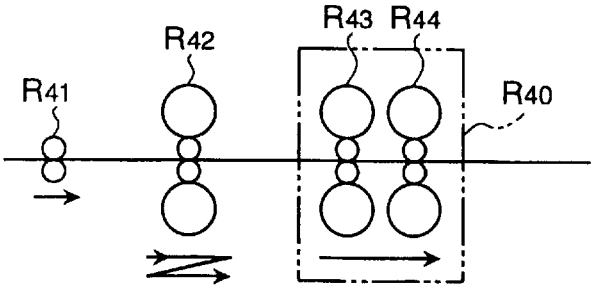
FIG.5d PRIOR ART
FIG. 5*d* is a schematic diagram of a close couple type rough rolling mill train of a conventional rolling mill equipment.

A fourth embodiment of the present invention is explained, referring to FIG. 4.

In this embodiment, a close mill couple 9A is provided instead of the close mill couple 9 of a third turn in FIG. 2, which close mill couple 9A has a 2-high rolling mill 5*a* provided with one 2-high rolling roll assembly (comprising one rolling roll at each of upper and lower sides) and a 4-high rolling mill 10 provided with one 4-high rolling roll assembly (comprising 2 rolling rolls at each of upper and lower sides) arranged in tandem close to each other. In this case, also, adjacent two rolling mills among the rolling mill 4A, the close mill couple 7 and the close mill couple 9A are spaced by such a distance that a rolled extended rolling material does not bestride the adjacent rolling mills 4A, 7, 9A. The construction and operation other than the above-mentioned are the same as the second embodiment. In FIG. 4, the same reference numbers as in FIG. 2 are given members equivalent to ones in FIG. 2.

In the rough rolling mill train shown in FIG. 4, since the rolling roll assembly of the rolling mill 5*d* of the close mill couple 9A at the inlet side is 2-high and the rolling roll assembly of the rolling mill 10 of the close mill couple 9A at the outlet side is 4-high, rolling only at the final stage is effected by the 4-high rolls, and rolling at more preceding stages is effected by the 2-high rolls. Therefore, it is possible to make the diameter of the final stage work rolls small, it is possible to roll a rolling material at an after stage which became thin while preventing the rolls from being flattened, and it is possible to control the rolling load to be small. Further, since rolling at the final stage is effected by the 4-high rolls, it is possible to refine sectional shape preciseness of a rough bar 11, and it is possible to simplify a construction by making the simplest 2-high rolls roll at more preceding stage.

According to the present embodiment as mentioned above, in addition to that the same effect as in the first and second embodiments is attained, since only the rolling roll assembly of the rolling mill 10 of the close mill couple 9A at an outlet side is made 4-high, it is possible to roll the rolling material at the after stage which became thin by the work roll small in diameter with a small rolling load. Further, it is possible to refine sectional shape preciseness of a rough bar 11, and it is possible to simplify a construction by making the simplest 2-high rolls roll at more preceding stage.

Further, in the above explanation, the rough rolling mill train in a hot rolling mill equipment for producing a thin plate by thickness-reducing hot-rolling of a flat slab is mainly explained, it is taken as matter of course to be applicable for other cases of producing plate material from rolling plate raw material in general. Further, in a case of producing a relatively thick plate material, the finish rolling mill equipment as in FIGS. 1–4 can be omitted.

Further, although it is not shown in the present embodiments, it is possible to provide at least one plate width adjustment rolling mill provided with vertical rolls at the inlet side of each close mill couple. Although it is possible to provide the above-mentioned plate width adjustment rolling mill between the rolling mills within the close mill couple, in this case, there is such a disadvantage that a distance between the rolling mills becomes long. Therefore, it is preferable to avoid provision of the above-mentioned plate width adjustment rolling mill between the rolling mills within the close mill couple as possible as it is allowed. In a case where a large width reduction in a width direction is necessary, it is desirable to provide, between a heating furnace and a rolling mill of a first turn of an inlet side, a so-called sizing press reducing width by a press system which is disclosed in U.S. Pat. No. 4,578,983, etc., for example.

As mentioned above, it is obvious that it is better to arrange the rolling mills within the close mill couple to be as close as possible to each other. Although it differs, it is preferable that the above-mentioned distance between the rolling mills is about 6 m or less.

According to the present invention, the following effects are obtained:

(1) Since two or more pairs of rolling mills or two or more close mill couples are provided at least at a rolling mill train outlet side, and two rolling mills arranged close to each other in each close mill couple roll a rolling material in turn, it is possible to reduce the number of times that a rolling material is developed on roller tables, and a drop in temperature of the rolling material can be suppressed. Further, since two rolling mills are arranged close to each other in the close mill couple, it is possible to reduce the length of the whole equipment.

(2) Since a distance between the close mill couples is made such a distance that a rolling material does not bestride adjacent close mill couples, it is possible to make large a rolling speed at a rolling mill particularly at a preceding stage side, and a contact time between the rolling material and the rolling rolls also can be shortened. Therefore, it is possible to suppress a drop in temperature of the rolling material and an elevation in temperature of the rolling rolls can be made small.

(3) Since the close mill couples effect one way rolling, a screw down amount at each rolling roll can be set in advance, the productivity is prevented from decreasing, and a drop in temperature of the rolling material also can be prevented.

(4) Since a rolling mill which selectively effects one pass one way rolling and 3 pass reversing rolling is used as a rolling mill of a first turn of an inlet of the rolling mill train, it is possible to control a screw down amount before entering the close mill couple according to the thickness of the rolling material.

(5) Since the rolling mill of the outlet side of the close mill couple of at least a final stage is made into 4 or more-high, multi roll rolling mill, it is possible to roll a rolling material at an after stage which became thin by the work roll of small diameter with a small rolling load. Additionally, it is possible to refine sectional shape preciseness of a rough bar, whereby it is possible to simplify a construction of rolling mill at a preceding stage.

What is claimed is:

1. A rough rolling mill train for producing a rough bar through rough rolling of a slab, wherein at least two close mill couples are provided in said rough rolling mill train at an outlet side thereof, each close mill couple being two rolling mills arranged in tandem close to each other to roll a rolling material in turn, and said at least two close mill couples are arranged so that the rolling material does not bestride adjacent two close mill couples.

2. A rough rolling mill train according to claim 1, wherein a rolling mill at a first turn of said rough rolling mill train from an inlet side of said rough rolling mill train is an independent single rolling mill for selectively effecting one pass one way rolling and three pass reversing rolling.

3. A rough rolling mill train according to claim 1, wherein a rolling mill of an outlet side of said close mill couple at least at a final stage of said rough rolling mill train from the outlet side thereof is a multi roll rolling mill having 4 or more-high rolling rolls.

4. A rough rolling mill train according to claim 2, wherein a rolling mill of an outlet side of said close mill couple at least at a final stage of said rough rolling mill train from the outlet side thereof is a multi roll rolling mill having 4 or more-high rolling rolls.

5. A rough rolling mill train for producing a rough bar through rough rolling of a slab, said rough rolling mill train comprising a first pair of rolling mills arranged in tandem and a second pair of rolling mills arranged in tandem, said first and second pairs of rolling mills being arranged at an outlet side of said rough rolling mill train, wherein said first pair of rolling mills and said second pair of rolling mills are positioned so that the slab to be roughly rolled does not bestride said first pair of rolling mills and said second pair of rolling mills.

6. A rough rolling mill train for producing a rough bar through rough rolling of a slab, wherein at least two twin mills are provided in said rough rolling mill train at an outlet side thereof, and said at least two twin mills are arranged so that the rolling material does not bestride adjacent two twin mills.

7. A method for rough rolling a slab of material into a rough bar in a rough rolling mill train comprising the steps of:

rough rolling the slab of material with a first pair of rolling mills arranged in tandem positioned at an outlet side of the rough rolling mill train;

rough rolling the slab of material with a second pair of rough rolling mills arranged in tandem wherein the second pair of rough rolling mills is positioned after the first pair of rolling mills at a distance such that during rough rolling, the slab of material being rough rolled in one direction does not bestride the first and second pairs of rolling mills at the same time.

* * * * *